United States Patent [19]

Maurer, Jr.

[11] Patent Number: 4,841,646

[45] Date of Patent: Jun. 27, 1989

[54] BODY WARMER APPARATUS

[76] Inventor: Leon P. Maurer, Jr., R.D. #1, Box 59A, Hegins, Pa. 17938

[21] Appl. No.: 150,734

[22] Filed: Feb. 1, 1988

[51] Int. Cl.[4] ..... A43B 7/02; A61F 7/08

[52] U.S. Cl. ..... 36/2.6; 126/204

[58] Field of Search ..... 36/2.6, 117, 132, 136; 126/204, 206

[56] References Cited

U.S. PATENT DOCUMENTS

| | | | |
|---|---|---|---|
| 3,547,100 | 12/1970 | Usui | 126/206 |
| 3,585,736 | 6/1971 | Polichena | 36/2.6 |
| 4,023,282 | 5/1977 | Ziegelheafer | 36/2.6 |
| 4,094,080 | 6/1978 | Sanders | 36/2.6 |
| 4,373,274 | 2/1983 | Michalski | 36/2.6 |
| 4,455,764 | 6/1984 | Rock et al. | 36/2.6 X |
| 4,688,572 | 8/1987 | Hubbard et al. | 126/204 X |

FOREIGN PATENT DOCUMENTS

| | | | |
|---|---|---|---|
| 3342276 | 6/1985 | Fed. Rep. of Germany | 36/2.6 |
| 2361837 | 3/1978 | France | 36/132 |

*Primary Examiner*—James Kee Chi

*Attorney, Agent, or Firm*—Leon Gilden

[57] ABSTRACT

A boot warmer apparatus is set forth wherein a pocket is secured to a boot in overlying orientation to the toe portion of the boot wherein a Velcro TM securable blind pocket accepts in frictional fashion a heating module for imparting warmth to a user of the instant invention. A plurality of straps are securable to the pocket portion of the apparatus and fastenable about the ankle portion of the boot structure for securement thereto.

1 Claim, 3 Drawing Sheets

BODY WARMER APPARATUS

BACKGROUND OF THE INVENTION

1. Field of the Invention

The present invention relates to boot warming devices, and more particularly pertains to a new and improved boot warmer apparatus which is securable about the toe portion of a boot and to the ankle portion of a boot to provide plural securement organizations and impart warmth to the associated boot by means of a warming module.

2. Description of the Prior Art

The use of boot warming means is well known in the prior art. As may be appreciated, these devices have typically been structurally integrated into the organization of the boot or have been of such bulky and awkward structure as to render their usage awkward and limited. In this connection, there have been several attempts to develop boot warming apparatus which may be easily and efficiently utilized when desired. For example, U.S. Pat. No. 4,094,080 to Sanders provides a superimposed portion wherein the portion securable to a boot by means of a lace and tie string arrangement has formed therein plurality of pockets for securement of portable heaters prior to the installation of the heating device to the associated boot or shoe. The Sanders patent, while a useful means for heating a boot, requires the removal of the device from the boot prior to the installation of the heating units and is of an extensive and elaborate organization, as compared to the instant invention.

U.S. Pat. No. 4,023,282 to Ziegelheafer sets forth an overshoe wherein a panel is fitted to a wearer's foot with a thermal sleeve overfitting at least a portion of the overshoe housing the toes of a wearer. The thermal sleeve is secured to the sole of the overshoe by adhesive layer. The patent presents a relatively complex boot structure as compared to the easily installed and utilized boot warming adjunct of the instant invention.

U.S. Pat. No. 3,585,736 to Polichena sets forth a boot with a cavity in a sole portion for positioning of a portable heater therein. The positioning and effectiveness of the Polichena patent is of relatively remote structural relationship to the instant invention.

U.S. Pat. No. 4,373,274 to Michalski sets forth a boot provided with a plurality of apertures overlying the instep portion such that a securable overlying member may selectively enclose a portable heater in the warming of the boot. The relatively elaborate organization of the Michalski patent requires a special boot as opposed to the instant invention that may be universally applied to any conventional boot or shoe.

U.S. Pat. No. 4,455,764 to Rock, et al., sets forth a warming cap mountable about the toe of a boot and securable thereunder by means of an associated snap fastening strap. An overlying compartment may house a warming unit. The Rock patent does not provide the securement to the boot nor is it as universally applicable due to the limited length of the housing as opposed to the instant invention that may be positioned based on comfort to an associated boot or shoe.

As such, it may be appreciated that there is a continuing need for a new and improved boot warming apparatus that addresses both the problems of effectiveness and comfort, and in this respect, the present invention substantially fulfills this need.

SUMMARY OF THE INVENTION

In view of the foregoing disadvantages inherent in the known types of boot warmer apparatus now present in the prior art, the present invention provides an boot warmer apparatus wherein a selectively securable boot warming chamber may be stored when not in use and may be further easily and effectively secured to a boot during periods of need. As such, the general purpose of the present invention, which will be described subsequently in greater detail, is to provide a new and improved boot warmer apparatus which has all the advantages of the prior art boot warmer apparatus and none of the disadvantages.

To attain this, the present invention comprises a boot warmer module accepting compartment for frictionally securing a boot warm module therein. The compartment is integrally formed to a strap for securement about the forward portion of a boot. A further plurality of straps enables securement of the instant invention about the ankle portion of a boot for providing plural securement devices to engage boot both vertically and horizontally with respect to the boot warming module and associated compartment.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boot warmer apparatus which has all the advantages of the prior art boot warmer apparatus and none of the disadvantages. It is another object of the present invention to provide a new and improved boot warmer apparatus which may be easily and efficiently manufactured and marketed.

It is a further object of the present invention to provide a new and improved boot warmer apparatus which is of a durable and reliable construction.

An even further object of the present invention is to provide a new and improved boot warmer apparatus which is susceptible to a low cost of manufacture with regard to both materials and labor, and which accordingly is then susceptible of low prices of sale to the consuming public, thereby making such boot warmer apparatus economically available to the buying public.

Still yet another object of the present invention is to provide a new and improved boot warmer apparatus which provides in the apparatuses and methods of the prior art some of the advantages thereof, while simultaneously overcoming some of the disadvantages normally associated therewith.

Still another object of the present invention is to provide a new and improved boot warmer apparatus wherein a boot warmer module accepting compartment frictionally secures a boot warming module therein.

Yet another object of the present invention is to provide a new and improved boot warmer apparatus wherein a plurality of straps secure the boot warmer compartment about the instep of an associated boot and further secure the compartment about the ankle portion of an associated boot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
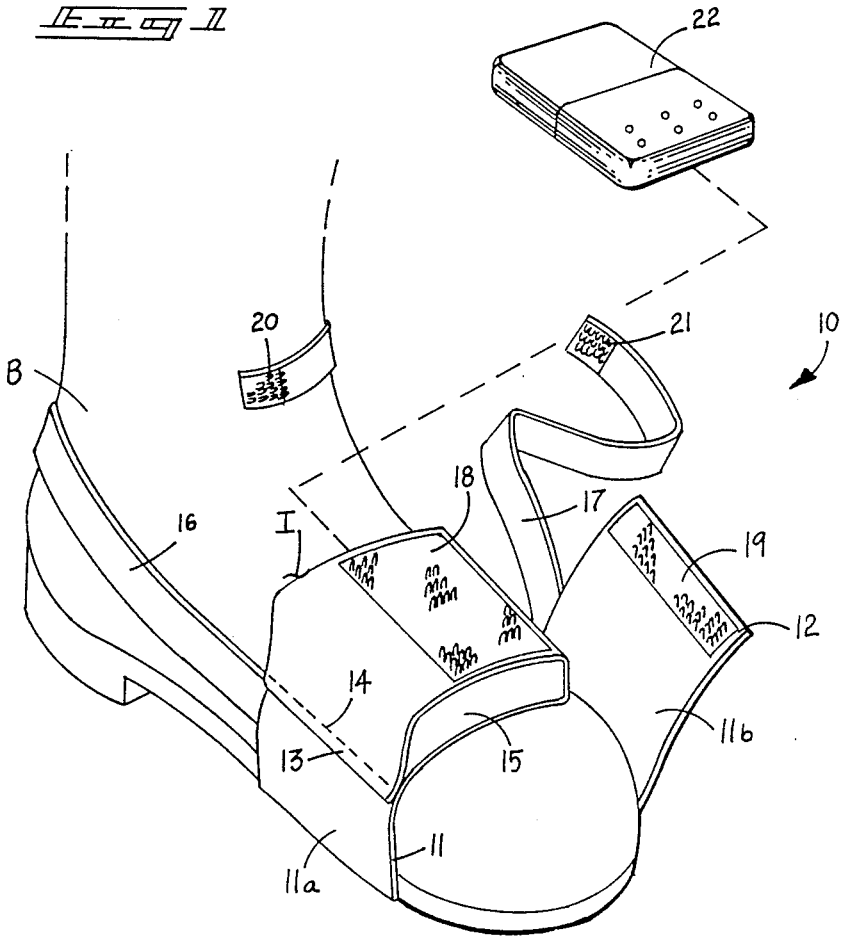
FIG. 1 is an isometric illustration of the instant invention securable about an associated boot.

With reference now to the drawings, and in particular to FIGS. 1 to 4 thereof, a new and improved boot warmer apparatus embodying the principles and concepts of the present invention and generally designated by the reference numeral 10 will be described.

More specifically, it will be noted that the boot warmer apparatus 10 essentially comprises a housing strap 11 of elongate length formed with a first side 11*a* and a second side 11*b*. A first terminal end 12 of housing strap 11 has formed thereto a Velcro TM loop housing attachment portion 19 for cooperation with an associated Velcro TM loop housing securement portion 18. The securement portion 18 is integrally secured by sewing or use of adhesives to a housing portion formed by the sewing of the second terminal end 13 onto first side 11*a* of housing strap 11. In lieu of the use of conventional sewing or stitching 14 for effecting the securement of second terminal end 13, adhesives and the like may be utilized for the same purpose. A closure member 15 adhesively secured or sewn onto a terminal end of the chamber formed by the oversewing of second terminal end onto housing strap 11 defines an open-ended compartment for reception of the warming module 22 therein onto instep portion 1 of the boot B.

A first ankle strap 16 and second ankle strap 17 are secured to the housing strap 11 wherein first ankle strap 16 is secured proximate the formed compartment defined by the securement of second terminal end 13 with second ankle strap 17 secured proximate the first terminal end 12 of housing strap 11. The other end of first ankle strap 16 has formed thereon a first strap securement portion formed of Velcro loops cooperative with a second strap attachment portion formed of Velcro hooks. It may be appreciated that the loops and hooks of the first and second strap 20 and 21 and the loops and hooks of securement portion 18 and 19 respectively may be reversed to effect the cooperative attachment of the various portions together.

Figure 2:
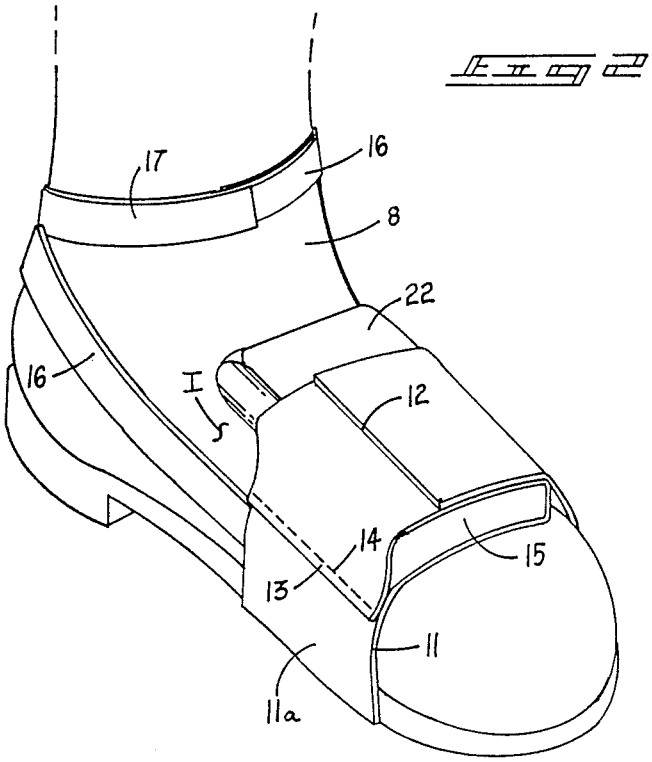
FIG. 2 is an isometric illustration of the instant invention assembled about an associated boot.
Figure 3:
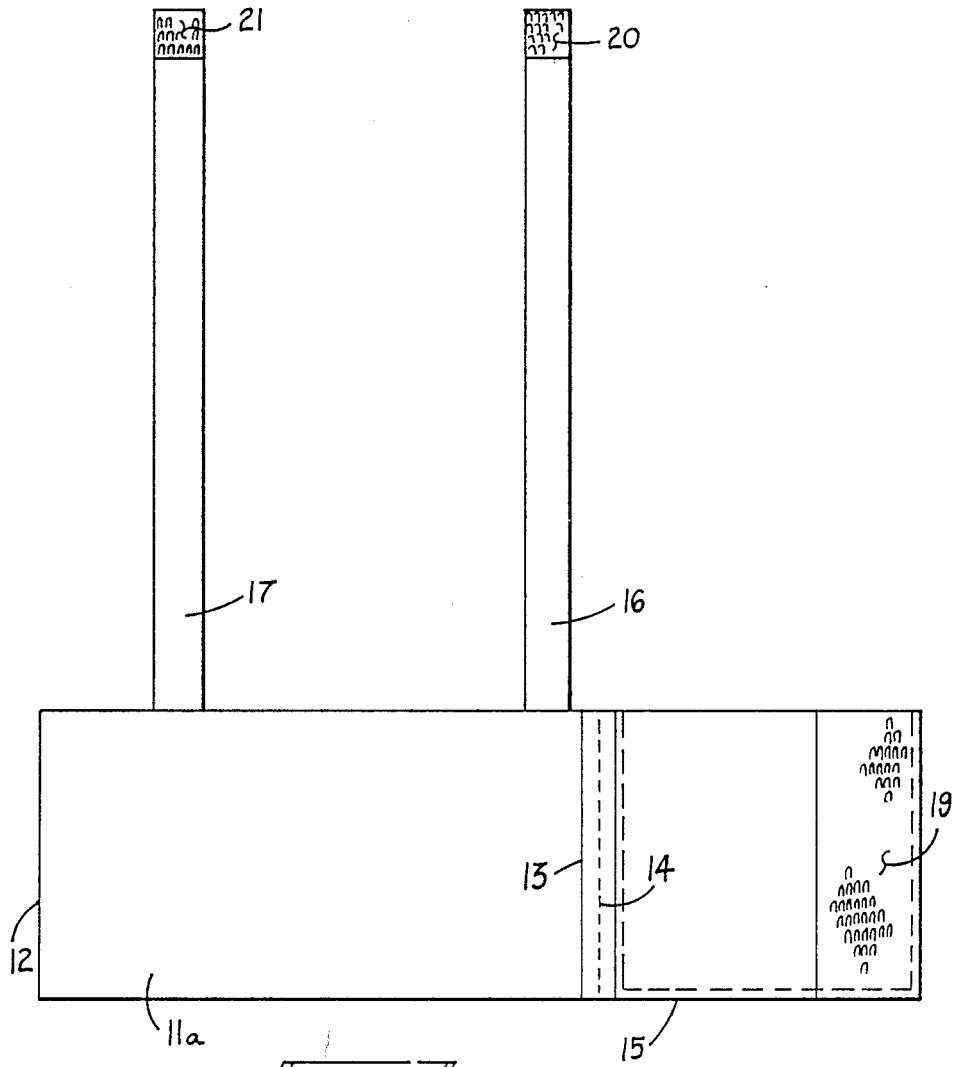
FIG. 3 is a top orthographic view of the instant invention.
Figure 4:
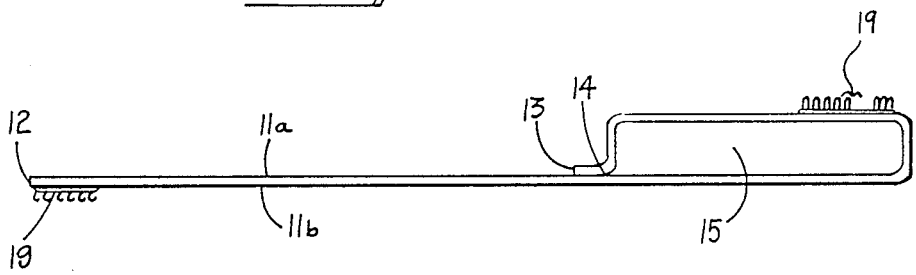
FIG. 4 is an end orthographic view of the instant invention.

As illustrated in FIGS. 1 and 2 particularly, the first ankle strap 16 depending from housing strap 11 is positioned lengthwise of associated boot "B" and wrapped about the ankle portion of the boot, essentially as illustrated in FIG. 1. The second attachment portion 21 is positioned along the boot "B" at the opposite side of the boot to the position of the first ankle strap 16 and wrapped around the ankle portion of the boot in a direction opposite that of the first ankle strap for attachment thereto, as illustrated essentially in FIG. 2.

The warming module 22 is frictionally and securably engaged within the compartment as formed by the oversewing of second terminal end 13 onto the first side 11*a* of housing strap 11. A non-slip arrangement is resultant as the compartment is of essentially the same cross-sectional configuration as that of the warming module 22.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not intended to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boot warmer apparatus for selective securement about a boot having an ankle portion, an instep portion and a sole portion wherein said apparatus comprises, an elongate flexible housing strap means for securement about said instep portion of sole portion of said boot with a warming module receiving compartment formed on said housing strap means and a first and second securement strap means joined to said housing strap for securement to said ankle portion of said boot, and said housing strap means includes a first side, a second side, a first terminal end and a second terminal end with said compartment formed on said housing strap means and extending upwardly of said housing strap means from said first side, and wherein said compartment is defined by said second terminal end secured to said first side with said second terminal end having an attachment portion secured proximate thereto on said second side, and wherein said compartment has formed at one end a closure member to define a closed end compartment with an open end orthogonally oriented relative to said first and second terminal ends and said open end extending upwardly of said housing strap means, and wherein said first and second securement strap means depend from said housing strap means along a linear edge of said housing strap means defining the open end of said compartment, and wherein said first securement strap means has formed thereto a hook fastening portion on a terminal end of said first housing strap cooperative with a loop fastener attachment portion on the second securement strap at its terminal end, and wherein said first and second housing strap means are spaced along said housing strap means a distance approximately equal to the width of an associated boot.

* * * * *